US005130084A

United States Patent [19]

Matheny et al.

[11] Patent Number: 5,130,084

[45] Date of Patent: Jul. 14, 1992

[54] POWDER FORGING OF HOLLOW ARTICLES

[75] Inventors: A. Paul Matheny, Jupiter; Paul M. Buxe, Lake Park, both of Fla.

[73] Assignee: United Technologies Corporation, Hartford, Conn.

[21] Appl. No.: 633,728

[22] Filed: Dec. 24, 1990

[51] Int. Cl.[5] ..... B22F 7/00

[52] U.S. Cl. ..... 419/8; 419/26; 419/49; 419/53; 419/54

[58] Field of Search ..... 419/8, 28, 53, 49, 54

[56] References Cited

U.S. PATENT DOCUMENTS

| | | | |
|---|---|---|---|
| 3,628,226 | 12/1971 | Nelson | 29/156.8 |
| 3,927,817 | 12/1975 | Hamilton et al. | 228/157 |
| 4,043,498 | 8/1977 | Conn, Jr. | 228/265 |
| 4,089,456 | 5/1978 | Topper et al. | 228/195 |
| 4,364,160 | 12/1982 | Eiswerth et al. | 29/156.8 |
| 4,417,381 | 11/1983 | Higginbotham | 29/156.8 |
| 4,584,171 | 4/1986 | Niino et al. | 419/8 |
| 4,642,863 | 2/1987 | Schulz | 29/156.8 |
| 4,756,677 | 7/1988 | Hribernik et al. | 419/8 |
| 4,772,450 | 9/1988 | Friedman | 419/49 |
| 4,861,546 | 8/1989 | Friedman | 419/8 |
| 4,925,740 | 5/1990 | Norris et al. | 419/9 |

FOREIGN PATENT DOCUMENTS 2349776 5/1974 Fed. Rep. of Germany .

*Primary Examiner*—Stephen J. Lechert, Jr.

[57] ABSTRACT

A method and apparatus are disclosed for fabrication of hollow articles by hot consolidation of metal alloy powder between a hollow core and a fluid pressure resistant outer shell. The hollow core is formed, a disposable layer is applied to define the object contour, a fluid pressure resistant metallic layer is formed over the disposable layer, which is then melted, removed and replaced by the metal alloy powder, and this assembly is hot isostatically pressed. The powder and core materials are preferably selected to be metallurgically compatible, so the core becomes an integral part of the finished article. The hollow article is inflated in a form die to establish the finished article contour.

12 Claims, 3 Drawing Sheets

POWDER FORGING OF HOLLOW ARTICLES

This invention was made with Government support under a contract awarded by the Department of the Air Force. The Government has certain rights in this invention.

TECHNICAL FIELD

This invention relates to the fabrication of hollow articles of high strength materials such as superalloys and titanium alloys, and more particularly to the fabrication of hollow articles employing hollow cores around which powdered metal is compacted and sintered.

BACKGROUND ART

Gas turbine engines contain a large variety of hollow structures. The temperatures and stresses under which most gas turbine engine components operate necessitate the fabrication of such structures from high strength, high temperature materials, such as titanium alloys and nickel-base or cobalt-base superalloys. These materials are expensive and generally very difficult and costly to machine; consequently, fabrication processes which can produce useful net, or near net, shapes are highly desired.

Airfoils mounted on rotating disks for use in gas turbine engines are usually subjected to high stresses and high temperatures during operation. Decreases in the weight of the airfoil can reduce operating stresses by reducing centrifugal force in these components, and can reduce the overall engine weight. Weight reduction is also important in stationary engine components, particularly for aircraft applications.

One potential technique for reducing weight is to use low density materials. Commonly available low density metals generally do not have properties suitable for withstanding temperatures and stresses encountered in the operation of these engines.

A more useful technique is to fabricate the airfoils from higher density heat resistant materials with hollow interiors, a technique which can provide internal cooling capability as well as weight reduction. This is commonly done by various techniques. For example, part halves can be cast or machined from solid stock with recesses on one or more mating surfaces such that when the halves are bonded together, components with hollow interiors are produced. Another technique builds up a hollow component from essentially flat sheets, which are then bonded together using either externally applied vacuum or internally applied pressure to conform the outer surfaces to a form die. Still another technique incorporates slicing of a solid component, hollowing out the interior, and rebonding the separated portions.

Another existing process utilizes an iron-base core prepared in the shape of the cavity desired in the hollow component. Superalloy or titanium alloy powder is forged around the iron-base core in a hot isostatic pressing (HIP) operation to form the desired article. The iron-base core is chemically removed to produce the hollow portion of the article. In addition to the high cost and waste disposal problems of this process, the surfaces of the cavity within the article can become contaminated This contamination must be removed in a subsequent operation.

With the importance of weight-reduction in aircraft propulsion applications, and the need to produce gas turbine engine components at minimum cost, it is highly desirable to develop methods for producing hollow objects from high-strength, high-temperature materials Accordingly, it is an object of the invention to produce hollow superalloy or titanium alloy objects in a cost-effective manner. It is another object of the invention to fabricate hollow cores, with or without internal bracing, which provide a cavity and become part of a hollow object

DISCLOSURE OF INVENTION

The invention process starts with at least two sheets of core precursor material The sheets are bonded together to form a core preform. A material used to prevent bonding (hereinafter referred to as stop-off) is placed between the sheets in those areas where bonding is to be prevented. An inflation tube is provided by, for example, inflation of an extension of the sheets or by fastening a piece of tubing to the preform.

The core preform is placed in a core inflation die at a temperature at which the bonded sheets have increased ductility. A gas is injected into the region between the two sheets where bonding was prevented by use of the stop-off This causes the sheets to expand and conform to the cavity in the core inflation die, thus forming a hollow article which is used as a core in subsequent operations. This process is essentially the same as that presented in U.S. Pat. No. 3,927,817, which is incorporated herein by reference.

An alternative method for forming the hollow core is to employ metal tubing of suitable material which can be inflated, in a manner similar to that used for inflation of the bonded sheets, to conform to the cavity in the core inflation die.

The hollow core is placed in a die, with appropriate positioning features, for example, extensions of the core or pins extending from the surfaces of the die cavity and in contact with the core, which control the space between the outer surface of the hollow core and the cavity of the die. The space varies in thickness and contour so as to provide regions of varying thickness in the final article. This space is filled with a disposable material, i.e., a material which can be easily removed by, for example, melting or dissolution, producing a replica of the die cavity when the die is removed. Although many suitable disposable materials are available, wax has been selected as most suitable for this application, and subsequent references to wax will be understood to include all suitable disposable materials.

The disposable layer is encapsulated by a fluid pressure resistant external metallic shell plated onto the outer surface. The wax layer is removed, leaving a space between the hollow core and the metallic shell, which space is controlled by the positioning features referred to above. This space is filled with metal alloy powder, evacuated, and sealed. The compositions of the metal alloy powder and core material are preferably selected to be metallurgically compatible, meaning that the core will bond to the powder during a high temperature compaction process without formation of any undesired phases, and become an integral part of the finished article.

The metallic shell-powder-core assembly is placed in a HIP vessel. At elevated temperature, high pressure gas inside the pressure vessel applies a hydrostatic force to inner and outer surfaces of the assembly, since the core is still open on one end. At the HIP temperature, the core material and the metallic shell have greatly reduced strength and provide very little resistance to movement under the effect of the HIP pressure. Thus, the metallic shell and the core move toward each other as a result of the applied gas pressure. The pressure exerted by the core and the metallic shell on the metal powder causes the powder to be compacted and sintered.

After HIP, the external metallic shell is removed by, for example, chemical milling. The resulting hollow article is placed in a final form die and heated to about the same temperature as that used for compaction and sintering. A gas is injected into the core through the core inflation tube to force the thin walls of the cavity of the hollow article outward, resulting in a hollow article whose outer surface conforms with the inner surface of the form die cavity.

A primary feature of the invention is the hollow core, which serves as the inner surface of the HIP container and transmits the gas pressure to the metal powder. A further advantage is that the hollow core facilitates inflation of the compacted airfoil in a final form die to achieve the external contour. Still a further advantage of the hollow core is that, by selecting the core to be metallurgically compatible with the metal powder, it can become integral with the powder during the HIP operation; as such, there would be no requirement that the core be removed in a subsequent operation. Still a further advantage is that, by elimination of the iron core, a chemical milling operation to remove the iron core is avoided. Additionally, there is no contamination by iron of the inner surface of the hollow article.

The foregoing and other features and advantages of the present invention will become more apparent from the following description and accompanying drawings.

BEST MODE FOR CARRYING OUT THE INVENTION

The invention process is best understood through consideration of FIGS. 1 through 8, which illustrate the fabrication sequence for formation of a hollow airfoil for a gas turbine engine.

Figure 1:
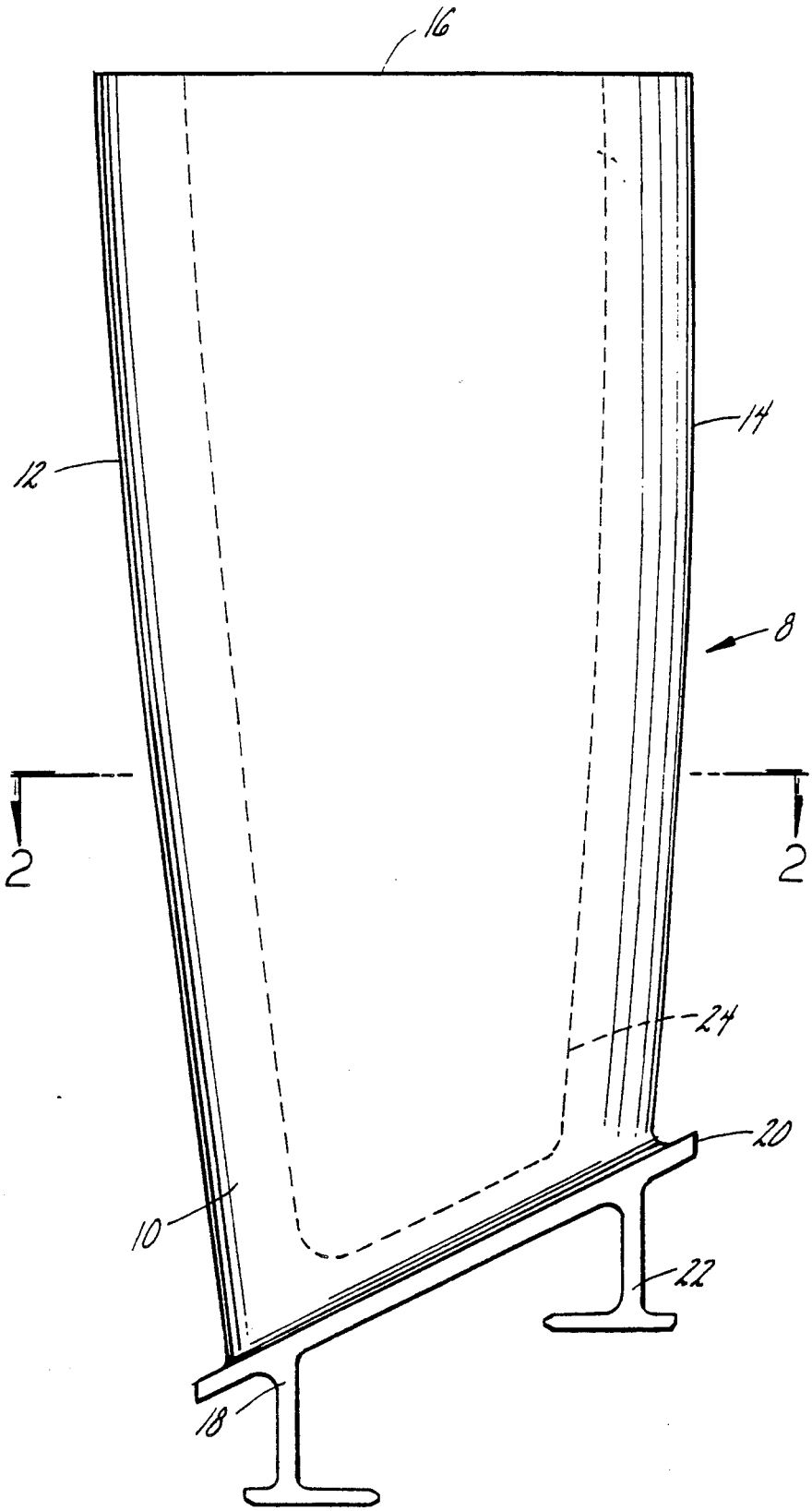
FIG. 1 shows a typical gas turbine engine airfoil with a hollow airfoil.

A typical gas turbine engine hollow airfoil is shown in FIG. 1. The vane 8 includes an airfoil 10 which is defined by a leading edge 12, a trailing edge 14, a tip region 16 and a root region 18. The root region includes a platform 20 and mounting lugs 22. A hollow portion 24, or cavity, is indicated by the broken line.

Figure 2:
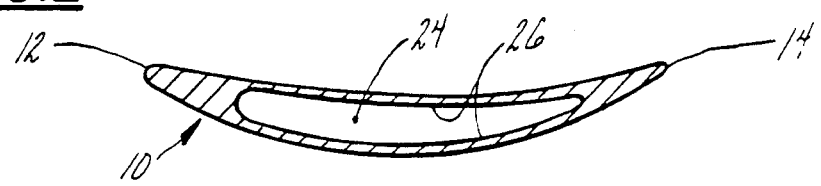
FIG. 2 is a cross section of the airfoil at Section 2—2 of FIG. 1.

A cross section of the blade at Section 2—2 of FIG. 1 is shown in FIG. 2. The leading edge 12 and the trailing edge 14 of the airfoil 10 are solid in order to provide resistance to damage from extraneous matter impacting the airfoil during operation of the engine. The cavity walls 26 are thick enough to withstand centrifugal forces and the pressure loading on the airfoil surfaces due to airflow through the engine, while being as thin as possible to maximize the volume of the cavity 24, thus maximizing the weight reduction of the airfoil, and, in addition, providing a passage for flow of cooling air, if so desired.

Figure 3:
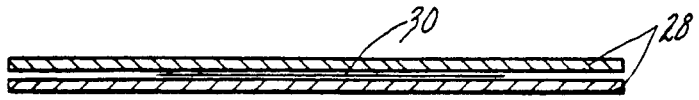
FIG. 3 is a cross section of a typical two-layer core preform.

FIG. 3 shows a cross section of two sheets of material 28 with stop-off 30, such as yttrium oxide applied by for example silk screening, between the sheets in those areas where it is desired to prevent bonding. The sheets of material are bonded by, for example, diffusion bonding, roll bonding or brazing, to form a core preform 32 as shown in FIG. 4.

Figure 4:
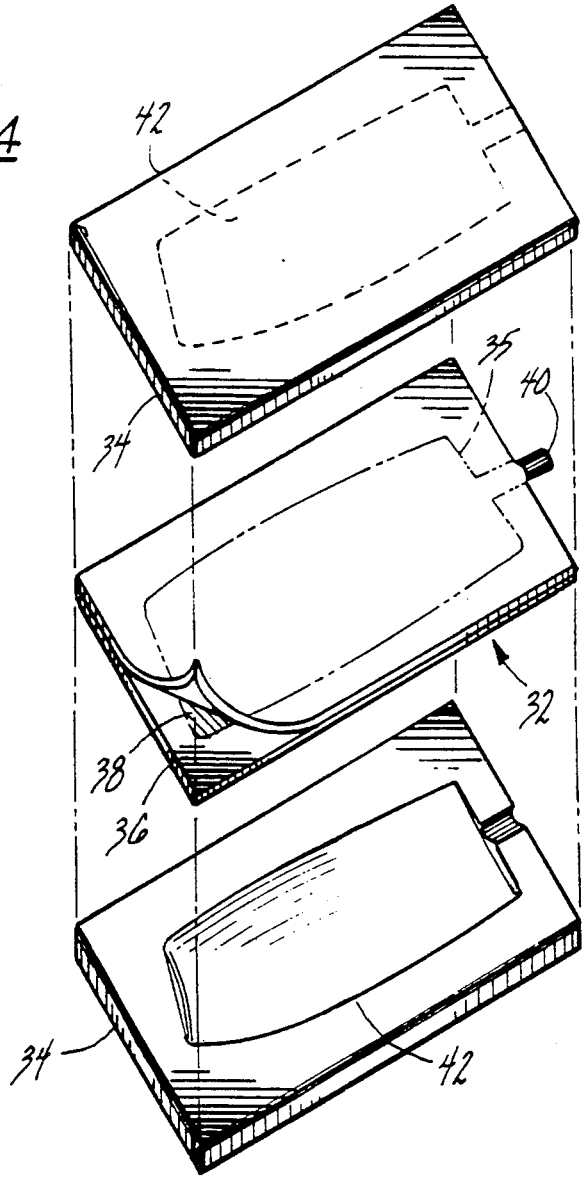
FIG. 4 is an exploded perspective view of a core inflation die and a core preform.

FIG. 4 shows an exploded perspective view of the core inflation die 34 and the core preform 32. The broken line 35 separates the bond region 36 from the area 38 where stop-off is applied to prevent bonding. An inflation tube 40 supplies a high pressure inflation gas which forces the unbonded portions of the preform outward against the surfaces of a cavity 42 machined into the two halves of the die 34, which will establish the shape of the hollow core. The inflation tube can be formed integrally from the preform material or can be provided by fastening a piece of tubing to the preform.

Figure 5:
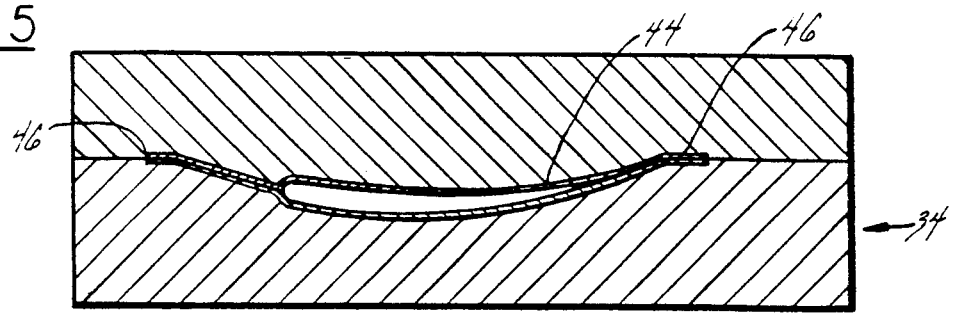
FIG. 5 is a cross section of a core inflation die with inflated core.

FIG. 5 shows a cross section of the core inflation die 34 with an inflated core 44 in position. The wings 46, or portions of the sheet material extending beyond the core 44, are used in the next step as supports for holding the core in position. Other methods for positioning the core, including, for example, pins of the same alloy as the blade positioned in the wax die cavity, are also possible.

Figure 6:
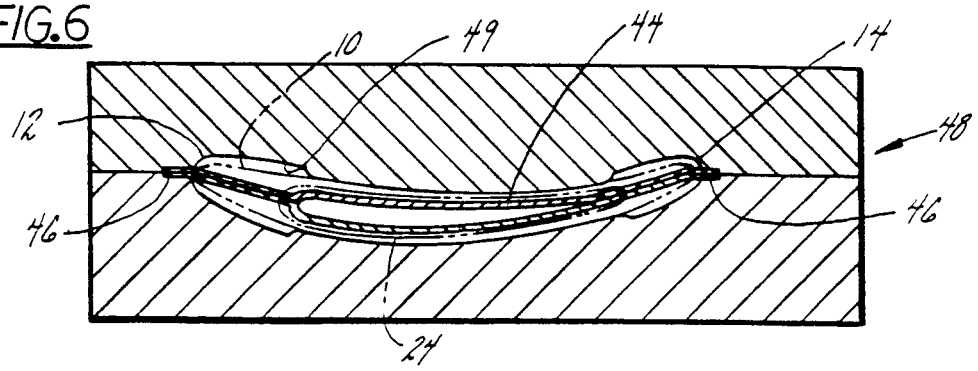
FIG. 6 is a cross section of a wax die containing a formed core.

FIG. 6 shows a cross section of the wax die 48 along with the inflated core 44. The outline of the finished airfoil 10 is shown for reference. It is noted that the outer dimensions of the cross section of the core 44 are smaller than the inner dimensions of the cross section of the airfoil cavity 24, and that the dimensions of the cross section of the cavity 49 of the wax die 48 are greater than the dimensions of the airfoil 10 in the regions of the leading edge 12 and the trailing edge 14 of the airfoil. The extra volume allows for compaction of the metal powder from which the airfoil is formed. The function of the wings of the core 46 in supporting the core in the cavity of the wax die is also noted. With the core in position in the wax die, wax is poured into the space between the core and the die.

The wax mold includes portions for the tip region and root region of the blade as necessary. These regions will also be oversized to allow for compaction of the metal powder.

The wax encased core is removed from the wax die and encased by a layer of electroplated nickel. The nickel layer effectively seals the wax filled space against fluid pressure at all points except where a powder fill tube (not shown) is inserted. It will be understood by those skilled in the art that it may be necessary to apply a conductive layer, for example a "paint" with fine nickel particles, on the surface of the wax layer, to provide a satisfactory conductive path for the electroplating operation.

The nickel plated wax encased core is heated to a temperature at which the wax melts and flows out of the cavity through the powder fill tube, leaving a space between the nickel layer and the core.

Figure 7:
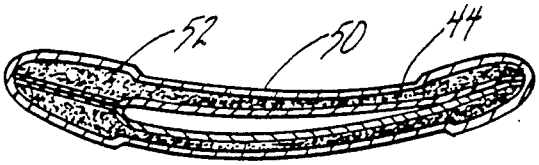
FIG. 7 is a cross section of the core surrounded by metal alloy powder and encapsulated by an external metallic shell.

A metal alloy powder is fed into the space through the powder fill tube. During filling, the assembly is vibrated to assure consistent filling of the space by the powder. By using a measured quantity of powder, the effectiveness of the filling operation can be gaged by observing the level of powder in the fill tube after the measured quantity of powder has been flowed into the space. After filling, a vacuum is drawn on the powder filled space by means of the fill tube, and the tube is crimped and welded to seal the powder filled space. FIG. 7 shows a cross section of the assembly with the nickel plate shell 50, the powder 52 and the core 44, ready for compaction and sintering.

The sealed assembly is placed in a HIP vessel, the assembly is heated to the compaction temperature, and high pressure is applied inside the HIP vessel. This causes the powder to be compacted and sintered, forming a solid, virtually void-free article with a cavity.

During the HIP operation, the pressure on the inside of the core is equal to the pressure on the outside of the assembly, since one end of the core remains open at the core inflation tube. The HIP operation is conducted at a temperature at which the core material and the nickel layer become quite weak. Thus the nickel layer and the core will move toward each other as the powder is compacted and sintered.

In the solid regions near the leading and trailing edges of the airfoil, the pressure exerted on the outer surface of the nickel layer is not counteracted by a high internal fluid pressure Thus, the nickel layer deforms inwardly to compress the powder inwardly in these leading and trailing edge regions. In this manner, the leading and trailing edge portions of the airfoil attain a near net shape configuration.

In the region of the airfoil cavity, the powder layer is compacted to form the walls of the cavity. Although the walls achieve the proper thickness they often deviate from the desired smooth curve of the airfoil surface because the cavity walls are unsupported during the HIP operation.

Figure 8:
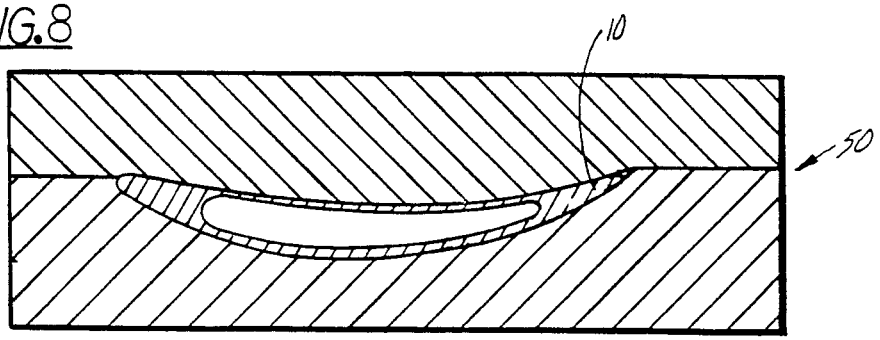
FIG. 8 is a cross section of the compacted airfoil in a final form die.

The nickel layer is removed from the surface of the airfoil in a chemical dissolution process. FIG. 8 shows the airfoil 10 in a final form die 50. The temperature is raised to the same temperature as used for compaction, and a high pressure inflation gas is injected through the tube which was originally used for inflation of the core. The mechanical pressure of the die brings the solid leading and trailing edge regions into conformity with the edges of the final form die cavity, and the inflation pressure forces the airfoil cavity walls outward into conformity with the central portion of the die cavity. It is noted that the airfoil as depicted in FIG. 8 does not show evidence of the core, since the compaction and sintering process causes the core to become integral with the powder as the airfoil is formed.

Figure 9:
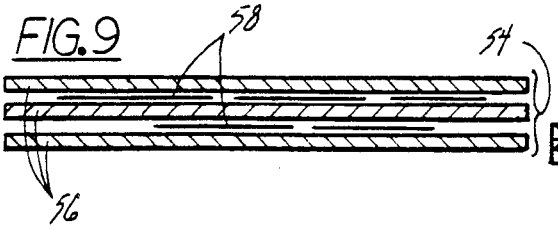
FIG. 9 is a cross section of a typical three-layer core preform.
Figure 10:
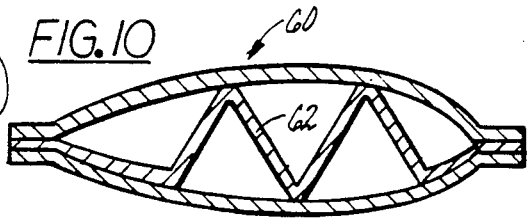
FIG. 10 is a cross section of an inflated core with internal bracing.

FIG. 9 shows a cross section of a core preform 54 consisting of three sheets of material 56 with stop-off 58 placed so that bonded and unbonded areas will be created. FIG. 10 shows a cross section of the resulting bonded and inflated core 60 with an internal bracing structure 62 to provide additional strength to the finished article. These internal braces can also be configured to direct and control airflow if desired. This same principle can also be applied to cores formed of more than three sheets of the core material.

Although this invention has been shown and described with respect to detailed embodiments thereof, it will be understood by those skilled in the art that various changes in form and detail thereof may be made without departing from the spirit and scope of the claimed invention.

We claim:

1. A method for forming hollow articles from metal alloy powders, using a hollow core, comprising:

a. providing a shaped disposable layer on the outer surface of said hollow core;

b. providing a fluid pressure resistant external metallic shell on the outer surface of said disposable layer joined to said hollow core;

c. removing said disposable layer leaving a space between said hollow core and said metallic shell;

d. filling said space with said metal alloy powder;

e. evacuating and sealing said powder-filled space; and f. compacting and sintering said metal alloy powder by a hot isostatic pressing (HIP) operation.

2. A method as recited in claim 1 wherein said disposable layer is wax.

3. A method as recited in claim 1 wherein, after hot isostatic pressing, said hollow article is placed inside a cavity in a form die and inflated to conform with said cavity of said form die by the application of internal fluid pressure at elevated temperature to establish a final outer contour.

4. A method as recited in claim 1 wherein said metal powder is selected from the group consisting of superalloys and titanium alloys.

5. A method as recited in claim 1 wherein said fluid pressure resistant external metallic layer is nickel.

6. A method as recited in claim 1 wherein said hollow core, being chosen to be metallurgically compatible with said metal alloy powder, bonds to said metal alloy powder thereby becoming an integral part of said hollow article.

7. A method of forming hollow articles from metal alloy powders comprising:

a. assembling at lest two sheets of core material with stop-off interposed in those areas where bonding is not desired;

b. bonding said sheets in the areas which are free of stop-off;

c. inflating said locally bonded sheets in the die to form a hollow core;

d. providing a shaped disposable layer on the outer surface of said hollow core;

e. providing a fluid pressure resistant external metallic shell on the outer surface of said disposable layer joined to said hollow core;

f. removing said disposable layer leaving a space between said hollow core and said metallic shell;

g. filling said space with said metal alloy powder;

h. evacuating and sealing said powder-filled space; and i. compacting and sintering said metal alloy powder by a hot isostatic pressing operation.

8. A method as recited in claim 7 wherein said disposable layer is wax.

9. A method as recited in claim 7 wherein, after hot isostatic pressing, said hollow article is placed inside a cavity in a form die and inflated to conform with said cavity of said form die by the application of internal fluid pressure at elevated temperature to establish a final outer contour.

10. A method as recited in claim 7 wherein said metal powder is selected from the group consisting of superalloys and titanium alloys.

11. A method as recited in claim 7 wherein said fluid pressure resistant external metallic layer is nickel.

12. A method as recited in claim 7 wherein said hollow core, being chosen to be metallurgically compatible with said metal alloy powder, bonds to said metal alloy powder thereby becoming an integral part of said hollow article.

* * * * *